United States Patent [19]

Goldfarb et al.

[11] 4,198,050

[45] Apr. 15, 1980

[54] GAME DEVICE WITH RELEASE RAMP AND SCORING RECESSES

[75] Inventors: Adolph E. Goldfarb, 4614 Monarca Dr., Tarzana, Calif. 91356; Delmar K. Everitt, Woodland Hills, Calif.; Ronald F. Chesley, La Crescenta, Calif.; Richard D. Frierdich, Canoga Park, Calif.

[73] Assignee: Adolph E. Goldfarb, Northridge, Calif.

[21] Appl. No.: 876,418

[22] Filed: Feb. 9, 1978

[51] Int. Cl.[2] ..... A63F 7/04; A63F 7/14

[52] U.S. Cl. ..... 273/120 R; 273/DIG. 31

[58] Field of Search ..... 273/120 R, 118 R, DIG. 31

[56] References Cited

U.S. PATENT DOCUMENTS

| | | | |
|---|---|---|---|
| 927,106 | 7/1909 | Bristow | 273/120 R |
| 1,676,804 | 7/1928 | Scheck | 273/DIG. 31 |
| 1,732,518 | 10/1929 | Jurs | 273/DIG. 31 |
| 1,983,044 | 12/1934 | Maynard | 273/120 R |
| 3,712,620 | 1/1973 | Goldfarb et al. | 273/120 R |
| 3,767,200 | 10/1973 | Lohr | 273/120 R |

FOREIGN PATENT DOCUMENTS

| | | | |
|---|---|---|---|
| 491271 | 3/1953 | Canada | 273/118 |
| 719608 | 10/1965 | Canada | 273/118 |
| 32105 | 7/1885 | Fed. Rep. of Germany | 273/120 R |
| 1908110 | 2/1969 | Fed. Rep. of Germany | 273/DIG. 31 |
| 636377 | 4/1928 | France | 273/108 |
| 421301 | 5/1947 | Italy | 273/DIG. 31 |
| 610691 | 10/1960 | Italy | 273/DIG. 31 |
| 13559 | of 1912 | United Kingdom | 273/120 |

*Primary Examiner*—Richard C. Pinkham
*Assistant Examiner*—Lawrence E. Anderson
*Attorney, Agent, or Firm*—Robert M. Ashen; Robert J. Schaap

[57] ABSTRACT

A competitive game device which comprises a frame having a rippled playing surface. The rippled surface is formed by a plurality of transversely extending spaced apart recesses separated by arcuately shaped transversely extending ridge portions. The various recesses are assigned scoring values and certain of the recesses also have higher scoring values than other recesses. Each player may have a plurality of balls bearing his indicia. For example, the balls of each player may be a different color. A ramp leads downwardly to the first recess and the players take turns releasing balls down the ramp and onto the rippled playing surface. In a preferred form, the values of successive recesses initially increase; however, if a player's ball goes past the highest value recess, he will get a lower score, by virtue of the ball landing in a lower scoring recess or other area such as a gutter. Two or more players may play the game with each attempting, not only to have his balls come to rest in a high scoring recess, but also attempting to displace or block the opponent or advantage his own scoring positions.

12 Claims, 4 Drawing Figures

GAME DEVICE WITH RELEASE RAMP AND SCORING RECESSES

BACKGROUND OF THE INVENTION

1. Purpose of the Invention

To provide certain new and useful improvements in competitive game devices, and, more particularly, to provide a competitive game device in which one or more players rolls one or more playing balls down a rippled playing surface having transversely extending recesses separated by transversely extending ridge sections and attempts to land the ball or balls in a high scoring recess.

2. Brief Description of the Prior Art

There have been many competitive games of chance or skill or both known in the prior art and which involve the rolling of a ball or shifting of a playing object such as a puck or disc to obtain a score. There are also prior art games in which an object such as a ball is moved over an irregular playing surface, although not a rippled playing surface of the type described herein.

In the game known as "shuffleboard", a disc is used in place of a playing ball. In this case one or more players attempts to propel the disc across a flat playing surface into one or more scoring areas. The scoring areas are sized and provided with a shape so that it is difficult to land the disc in higher scoring areas.

Another prior art game in which a ball is rolled on a playing surface to achieve a score is known as "Zig-Zag-Zoom." This game utilizes a frame having a longitudinally extending playing surface and which is concave in the transverse dimension. In this way, the playing surface has a lower longitudinally extending edge portions. Located within the lower center portion are a plurality of longitudinally spaced apertures. In this game, one or more players attempts to roll a playing ball in a somewhat serpentine path around each of the apertures in the lower center portion from one end to the other in an attempt to reach the other end or move the ball as far as possible before landing the ball in any of the apertures. The distance the ball moves will determine the score of a player.

There is yet another prior art game which involves the use of a rolling ball in order to achieve a score and which is known as "Cris-Cross". In this game, the players take turns attempting to roll one or more balls down a serpentine playing chute. The game is also provided with a longitudinally extending intercepting track which intersects the serpentine chute at various points. When one player rolls a ball down the chute, the opponent will roll a ball down the intercepting track and attempt to contact and knock the player's ball out of the chute at one of the intersections of the chute and the track. The scoring may be determined by how far the balls proceed along the chute, if they are knocked off, and where they come to rest if knocked off.

OBJECTS OF THE INVENTION

It is, therefore, a primary object of the present invention to provide a competitive game device having a rippled playing surface formed by a plurality of transversely extending recesses, and in which a player attempts to roll a playing ball along the rippled playing surface to attempt to land in a high scoring recess.

It is another object of the present invention to provide a competitive game of the type stated in which a downwardly inclined ramp is provided at one end of the playing surface and in which the player of the game attempts to release the playing ball on the ramp in a position so that the ball will land in a high scoring recess.

It is a further object of the present invention to provide a competitive game device of the type stated in which succeeding recesses have higher scoring values, after which scoring values are lower.

It is another object of the present invention to provide a competitive game device of the type stated wherein the recesses are arranged and proportioned to create the appearance that the ball is increasing speed as it progresses.

It is an additional object of the present invention to provide a competitive game device of the type stated in which two or more players may play the game with each having a set of differently identified balls and with interplay between the players whereby each attempts to displace or block the balls of the opponent.

It is also an object of the present invention to provide a competitive game device of the type stated which can be made in the form of a relatively small table toy for children, or otherwise can be made in a large-scale construction for use in arcades and the like for play by adults.

It is another salient object of the present invention to provide a game in which a player rolls a ball down a rippled playing surface and attempts to land the ball in a high scoring recess.

It is yet another object of the present invention to provide a competitive game device of the type stated which can be manufactured at a relatively low unit cost and which is highly durable in its construction.

With the above and other objects in view, my invention resides in the novel features of form, construction, arrangement and combination of parts presently described and pointed out in the claims.

SUMMARY OF THE DISCLOSURE

The disclosed competitive game includes a frame which supports a longitudinally extending rippled playing surface having a starting end. The surface has a plurality of longitudinally spaced, transversely extending recesses or troughs and with each recess being separated from the next recess by an upstanding arcuately shaped ridge.

Certain of the recesses have a higher scoring value than other of the recesses in the play of the game. In a preferred embodiment, each succeeding recess in the direction of movement of a playing ball has a higher scoring value than the next preceding recess. A downwardly inclined ramp leads into the starting end of the playing surface and a no-score gutter is located at the opposite end of the surface beyond the highest scoring recess.

The players may each have a set of balls identified as theirs. For example, each set of balls may be a different color. Each player attempts to release a playing ball on the ramp in a position where the playing ball will roll into the highest scoring recess without rolling into the gutter. Thus, if the player releases the playing ball at too high a position on the ramp, the playing ball will roll down the playing surface and beyond the last scoring recess and into the gutter. Conversely, if the player does not release the playing ball at a point high enough on the ramp, the ball will come to rest in a recess short of the highest scoring recess.

The scoring values of the recesses may take various alternate forms. It is, however, desirable in providing a skill game that the values initially increase from recess to recess, and that the values then decrease. This creates a goal of having the ball roll to a desired location for the maximum score, with the score being less if it rolls too far or not far enough. By way of example, after the highest scoring recess, there may be recesses decreasing in scoring value instead of the gutter.

The present invention provides means of interplay between two or more competitive players. In this way, one or more of the players may attempt to block or otherwise displace the playing balls of the opponent player. For example, if one player lands his playing ball in the highest scoring recess, the opponent player may attempt to roll his playing ball in order to knock the opponent's playing ball out of the highest scoring recess and into a gutter or lower scoring recess. In addition, the players may position their playing balls in a manner to block the possible paths of movement of the balls of the opponent player.

The playing surface is designed so each recess has a dimension which is shorter than the preceding recess in the longitudinal direction, that is, the direction of movement of the playing balls. In other words, the frequency of each of the ridge portions separating the various recesses or troughs increases from the ramp toward the gutter. Thus, as the playing ball is moved and is rolled off of the ramp, the speed of movement of the playing ball visually appears to increase with each succeeding recess even though the ball is slowing down. Inasmuch as the successive recesses each have a shorter dimension in the direction of movement of the balls, it is more difficult to land the playing balls into these recesses of shorter dimension, thereby increasing the necessary skill involved in playing the game. In this way, the player of the game must very carefully select the position on the playing ramp in which he releases the playing ball. The player must also take into account the fact that the speed of the ball will visually appear to increase as the ball travels through each of the successive recesses.

The illustrated game device is also uniquely designed so that it can be easily leveled for play. For this purpose, the frame is provided with a plurality of depending height-adjustable legs. In order to level the game board in the transverse dimension, the playing ball is placed in one of the troughs and the legs can be adjusted so that the ball will not roll from side-to-side in the transverse dimension, thereby indicating a leveling in the transverse dimension. In addition, one or both of the frame rails may be provided with a groove, and when the ball is placed in the groove, the legs can then be adjusted in order to obtain leveling in the longitudinal dimension.

BRIEF DESCRIPTION OF THE DRAWINGS

Figure 1:
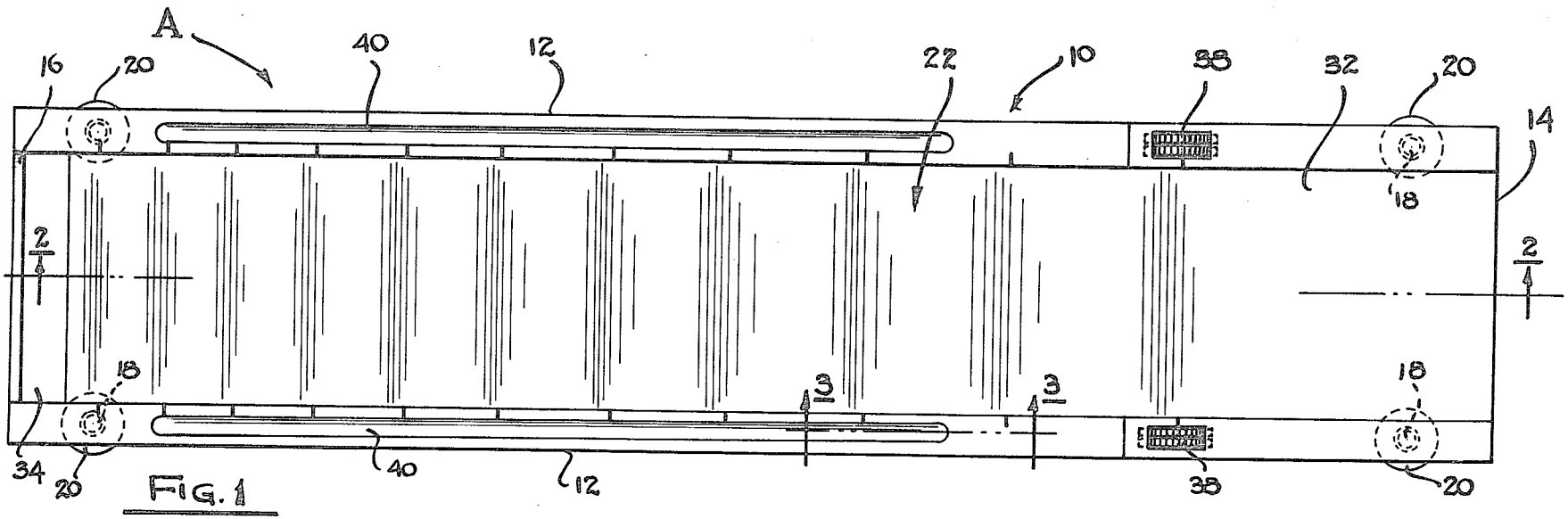
Figure 2:
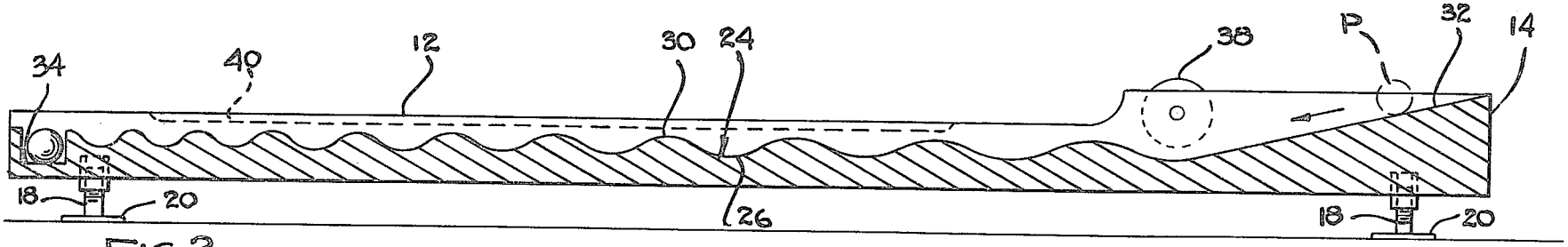
Figure 3:
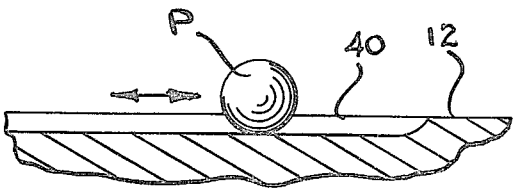
Figure 4:
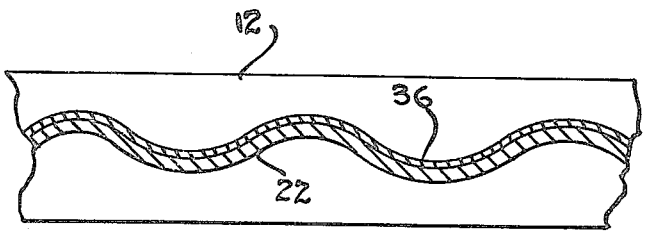

Having thus described the invention in general terms, reference will now be made to the accompanying drawings in which:

FIG. 1 is a top plan view of a game device constructed in accordance with and embodying the present invention;

FIG. 2 is a vertical sectional view of the game device of FIG. 1, substantially taken along line 2—2 of FIG. 1;

FIG. 4 is a fragmentary vertical sectional view, somewhat similar to FIG. 2, and showing a modified form of game device constructed in accordance with and embodying the present invention; and FIG. 3 is a fragmentary vertical sectional view showing a playing ball in one of the leveling grooves on the game device of the present invention.

DETAILED DESCRIPTION OF A PREFERRED EMBODIMENT

Referring now in more detail and by reference characters to the drawings which illustrate a preferred embodiment of the present invention, A designates a competitive game device comprising an outer frame 10 having a pair of transversely spaced apart longitudinally extending side walls 12. The side walls 12 are connected at their rearward end by an upstanding frame and wall 14 and at their forward end by an upstanding frame and wall 16 which is shorter in the vertical dimension than the frame and wall 14.

The frame 10 is provided with four rectangularly located height adjustable legs 18 having foot pads 20 thereon. The adjustable legs 18 with the foot pads 20 are essentially conventional in their construction and therefore neither illustrated nor described in further detail herein. However, it can be observed that the adjustable legs 18 enable the user of the game to level the frame 10 for purposes of play as hereinafter described in more detail.

Located within the frame 10 is a playing surface 22 which is rippled in its construction and is provided with a plurality of longitudinally spaced apart, transversely extending troughs or recesses 24 which are arcuate in their shapes. Each recess 24 is defined by a low point 26 having a pair of upwardly located arcuately shaped walls 28 and which merge into the next adjacent recess through an arcuately shaped ridge 30.

At the player end, that is the right-hand end of the game device, a ramp 32 leads into the first recess or trough 24 which then extends into the second of the recesses 24 in the manner as previously described. In this case, it can be observed that the ramp 32 extends to the upper edge of the end wall 14 of the frame 10 in the manner as illustrated in FIGS. 1 and 2 of the drawings. In this way, a portion of the ramp has a higher level than any of the recesses or the arcuate connecting ridges. At the other end of the playing surface 22, the endmost of the troughs 24 leads into a depressed gutter 34 to receive the playing ball P which rolls beyond the playing surface 22. A ball return area or the like could be used in place of the gutter 34.

The various components forming part of the game device of the present invention can be formed of a number of known plastic materials, as for example, polyethylene, polystyrene, polybutadiene, various vinylidene copolymers and the like, and which may be formed in a number of known plastic molding operations, as for example, blow-molding, thermo-forming, injection molding or the like. In addition, for purposes of increased strength and durability, many of the components could be formed of reinforced plastic materials including, for example, fiberglas, boron, carbon and other fibers and grown crystal whiskers incorporated in a suitable matrix, such as an epoxy resin or other thermo-plastic or thermo-setting resin. Notwithstanding, many of the components of the game device could be formed of other known structural materials, such as metals, etc.

The playing ball P is of any conventional type and is designed for use with the game device A. In this case, the playing ball P should have at least sufficient weight so that when released and rolled from the ramp 32, it can roll through all of the troughs 24 and into the gutter 34.

The playing surface 22 may be provided with a cloth or other covering 36, in the manner as illustrated in FIG. 4 of the drawings, so as to provide different rolling characteristics to the playing ball P. Again, the type of covering 36 and the thickness thereof will affect the rolling characteristics of the playing ball P. In this way, the covering 36 can be selected in order to give the desired rolling characteristics to the playing ball P.

By reference to FIG. 2, it can be observed that the frequency of the connecting ridges 30 increases from the player end toward the left-hand of the game device A such that each trough 24 has a dimension in the longitudinal direction which is shorter than the preceding trough.

It can also be observed that as the playing ball P is rolled down the ramp 32, it will move through each of the troughs 24 and as the ball P moves through each of the troughs 24, due to the increased frequency of each of the ridges 30, the speed of the ball will appear to be increased slightly. This will occur simultaneously with the fact that the movement of the ball tends to slow down due to the fact that most of the momentum initially achieved from rolling down the ramp 32 has been dissipated.

If desired, the playing surface 22 is slightly inclined from the player end, that is the right-hand end as illustrated in FIG. 2, toward the left-hand end. In this way, each succeeding recess would be somewhat lower than the preceding recess in the direction of movement of a playing ball P, as hereinafter described.

Each of the troughs 24 will have a scoring value associated therewith and the scoring value may of course be imprinted on the upper surface of the trough 24. Due to the fact that it is more difficult to land the playing ball P toward those troughs or recesses toward the left-hand end of the game board, the troughs will have a scoring value such that the first of the troughs 24 in the direction of movement of the playing ball, that is, the trough nearest the ramp 32, will have a lower scoring value than those throughs toward the gutter 34. Thus, each succeeding trough will have a higher scoring value than the preceding trough in the direction of movement of the playing ball.

It should be understood that troughs other than the trough adjacent the gutter 34 could have the highest scoring value. Thus, for example, the center trough or one of the troughs near the ramp could have the highest scoring value.

In order to play the game, a player will release the ball on the ramp 32 and permit the ball, with the momentum acquired thereby, to roll through the various troughs 24. The player will have to very carefully select the height on the ramp 32 in which to release the ball so that it ends at the highest scoring value recess 24 or at least one of the recesses close to the gutter 34 which has the higher scoring value. If the player selects too low a level on the ramp 32 to release the ball, it will not roll very far and will land in one of the lower scoring recesses or troughs 24. In like manner, if the player selects too high a level on the ramp 32, the ball will roll beyond the last of the recesses 24 and into the gutter 34 which has no score value. Thus, the players must be careful to ensure that they roll the ball from a position on the ramp 32 so that it will not roll into the gutter 34.

As indicated above, due to the fact that the frequency of the ridges 30 is increased successively toward the gutter 34, the speed of the ball appears to increase slightly as it moves toward the higher scoring recesses. However, while the speed does appear to increase due to the frequency of the ridges 30, the ball is actually slowing down, which renders an optical illusion to the player. This must be taken into consideration by the player of the game to avoid the ball from rolling into the gutter 34.

It is not necessary to have the successive recesses with shorter dimension in the direction of movement of the playing ball or playing balls. However, this does increase the necessary skill in playing the game, and also provides an added excitement in that the playing ball appears to be going faster through the successive recesses even though the ball is slowing down.

In the preferred mode of play, each of the players are provided with a plurality of playing balls and the playing balls for each player are identified in such manner so as to distinguish them from the playing balls of an opponent player or opponent players. Various forms of encoding the playing balls of each player may be employed. Thus, for example, color encoding may be employed where one player is provided with all balls of one color, e.g. red, a second player is provided with playing balls of a second color, e.g. blue, and a third player is provided with playing balls of a third color, e.g. white, and so forth. Other means may be employed for encoding the playing balls. Thus one player may have only one stripe on each of his playing balls, a second player may have a pair of stripes on his playing balls and so forth.

When playing the game, each of the players may take turns in successively rolling one or more of their playing balls down the inclined ramp to attempt to land in the highest scoring recess. Thus, for example, a first player may roll his playing ball down the ramp and attempt to land in the highest scoring recess or at least one of the higher scoring recesses. The second player and the third player, etc., will then follow suit.

As a means of interplay, the players may attempt to knock the opponent player's ball or balls out of a higher scoring recess and into a lower scoring recess or a lower scoring or no-score gutter. The players may also knock their own playing balls into higher scoring recesses.

In addition, the players may attempt to block the potential ball rolling paths of an opponent player and thus attempt to prevent an opponent player from landing his playing ball into a higher scoring recess or to attempt to prevent the opponent player from knocking one of his own balls into a higher scoring recess. Thus, for example, if one player rolls the playing ball P into one of the higher scoring recesses close to or at least adjacent to the gutter 34, the next player may attempt to roll another playing ball P in a position where it knocks the opponent player out of the higher scoring recess and into the gutter 34, thereby destroying any scoring value or lowering the scoring value.

The scoring may adopt various forms. However, in the preferred embodiment, the players will each attempt to land a given number of playing balls in the higher scoring recess and that will determine the score of the player. Thus, the player having the highest score after rolling the given number of balls will win the game.

It is also possible for a player to compete against himself or herself, in an attempt to achieve a higher score in a given number of games played by that one player. In this respect, it should be observed that the game can be played competitively in the sense that a player may play against himself or herself, or against another opponent player or opponent players.

The frame 10 is provided on the two longitudinal side walls 12 with a pair of conventional score keeping devices 38 in order for two or more players to record their scores through successive rolls of the playing balls P. Any type of scoring devices could be employed in connection with the present invention; although the devices 38 in this embodiment comprise a pair of rotatable wheels with scoring indicia thereon.

The game device A can be very easily and conveniently leveled by merely placing the playing ball P in one of the troughs 24. By adjusting the adjustable legs 18, it is possible to level the frame 10 in the transverse dimension. Thus, if the ball moves to one longitudinal side wall 12, that portion of the frame has to be raised. The longitudinal side walls 12 are also provided with a pair of grooves 40 in which to receive the playing ball P in the manner as illustrated in FIG. 3. In this way, it is possible to adjust the frame 10 for longitudinal leveling. Thus, if the playing ball P is placed in one of the grooves 40 and rolls to one end of the groove, then it is necessary to adjust the legs proximate to that end of the groove. In this way, it is possible to level the frame 10 in both the longitudinal and transverse dimensions. If desired, a leveling indicator could be mounted on the frame for purposes of leveling the same. Other forms of interplay could be used in accordance with the present invention.

Thus, there has been illustrated and described a unique and novel competitive device of skill in which one or more players roll one or more playing balls down a rippled playing surface trying to land the ball or balls in a highest scoring recess, and which therefore fulfills all of the objects and advantages sought therefor. It should be understood that many changes, modifications, variations and other uses and applications of the competitive game device will become apparent to those skilled in the art after considering this specification and the accompanying drawings. Therefore, any and all such changes, modifications, variations and other uses and application which do not depart from the nature and spirit of the invention are deemed to be covered by the invention which is limited only by the following claims.

Having thus described our invention, what we desire to claim and secure by Letters Patent is:

1. A competitive game device comprising:

(a) frame means, (b) a longitudinally extending playing surface on said frame means having a starting end and a plurality of longitudinally spaced apart generally transversely extending recesses separated by ridge portions with at least one of the recesses having a higher scoring value than other of the recesses, said recesses being generally level from side to side, said playing surface being provided by a covering layer, there being a first pair of adjacent successive recesses and a second pair of adjacent successive recesses, said first pair being closer to said starting end, the recesses of said first pair being further apart than the recesses of said second pair, and (c) a ramp on said frame means inclined downwardly to the starting end of the playing surface so that a player may release a playing ball on said ramp so that the ball will roll from said ramp through at least one of the recesses, and with the player attempting to determine the proper position on the ramp to release said ball so that the ball will roll so as to maximize his score, said frame means being provided with a plurality of upstanding rails on opposite longitudinal sides of said playing surface, a groove being formed in at least one of said rails for leveling said playing surface in a longitudinal direction.

2. The competitive game device of claim 1 further characterized in that each succeeding recess has a dimension in the direction of movement of the ball which is shorter than the preceding recess.

3. The competitive game device of claim 1 further characterized in that said ramp has a relatively flat surface portion inclined upwardly to a point higher than any of said recesses.

4. The competitive game device of claim 1 further characterized in that each of said recesses are arcuate in shape and each of said ridges are arcuate in shape leading out of one recess and into the next successive recess.

5. The competitive game device of claim 1 further characterized in that (a) each succeeding recesses has a dimension in the direction of movement of the ball which is shorter than the preceeding recess, (b) said ramp has a relatively flat surface portion higher than any of said recesses, and (c) each of said recesses are arcuate in shape and each of said ridges are arcuate in shape leading out of one recess and into the next successive recess.

6. The competitive game device of claim 1 further characterized in that each of said recesses is provided with a scoring indicia.

7. The competitive game device of claim 1 wherein said covering layer is comprised of cloth.

8. The competitive game device of claim 1 further characterized in that each successive recess in the direction of movement of the playing ball has a higher scoring value than each preceeding recess.

9. The competitive game device of claim 8 further characterized in that a gutter is located at the end of said playing surface opposite said ramp to receive the playing ball if it rolls beyond the last of said recesses.

10. The competitive game device of claim 8 further characterized in that each succeeding recess has a dimension in the direction of movement of the ball which is shorter than the preceeding recess.

11. The competitive game device of claim 8 further characterized in that each of said recesses are arcuate in shape and each of said ridges are arcuate in shape leading out of one recess and into the next successive recess.

12. The competitive game device of claim 8 further characterized in that each of said recesses is provided with a scoring indicia.

* * * * *